US006786482B2

(12) United States Patent
Spatz

(10) Patent No.: US 6,786,482 B2
(45) Date of Patent: Sep. 7, 2004

(54) MATERIAL HANDLER APPARATUS

(75) Inventor: Jeffrey M. Spatz, Lee's Summit, MO (US)

(73) Assignee: Hallmark Cards Incorporated, Kansas City, KS (US)

( * ) Notice: Subject to any disclaimer, the term of this patent is extended or adjusted under 35 U.S.C. 154(b) by 0 days.

(21) Appl. No.: 09/775,311

(22) Filed: Feb. 1, 2001

(65) Prior Publication Data

US 2003/0002956 A1 Jan. 2, 2003

(51) Int. Cl.[7] ..... B65H 29/00
(52) U.S. Cl. ..... 271/185; 271/186; 271/204
(58) Field of Search ..... 271/204, 205, 271/186, 185; 198/375, 377.07, 378

(56) References Cited

U.S. PATENT DOCUMENTS

| | | | | | |
|---|---|---|---|---|---|
| 1,025,926 | A | | 5/1912 | Runyan | |
| 3,034,632 | A | | 5/1962 | Wampler | 198/33 |
| 4,120,244 | A | | 10/1978 | Wirz | 101/230 |
| 4,404,905 | A | | 9/1983 | Simeth | 101/183 |
| 4,443,094 | A | | 4/1984 | Ricciardi | 355/3 |
| 4,448,408 | A | * | 5/1984 | Faltin | 271/204 X |
| 4,470,593 | A | * | 9/1984 | Halff et al. | 271/204 X |
| 4,693,362 | A | * | 9/1987 | Kemmerer et al. | 271/204 X |
| 5,020,789 | A | | 6/1991 | Droge et al. | 271/225 |
| 5,201,516 | A | * | 4/1993 | Cherian et al. | 271/204 X |
| 5,374,093 | A | * | 12/1994 | Klopfenstein | 271/204 X |
| 5,562,279 | A | * | 10/1996 | Gillieron | 271/204 |
| 5,730,055 | A | | 3/1998 | Dopke | 101/230 |
| 5,758,576 | A | * | 6/1998 | Mack et al. | 271/204 X |
| 5,836,706 | A | | 11/1998 | Ruhe | 400/636 |
| 5,931,459 | A | * | 8/1999 | Landgren | 271/204 |
| 5,957,598 | A | | 9/1999 | Berkers | 400/630 |
| 5,962,832 | A | | 10/1999 | Dorner | 235/380 |
| 6,017,161 | A | | 1/2000 | Harris | 400/625 |
| 6,089,158 | A | * | 7/2000 | Barroso | 271/204 X |
| 6,179,111 | B1 | * | 1/2001 | Ratz | 271/204 X |
| 6,227,589 | B1 | * | 5/2001 | Brown et al. | 271/204 X |
| 6,296,246 | B1 | * | 10/2001 | Boorsma | 271/186 |
| 6,488,278 | B1 | * | 12/2002 | Hansch | 271/204 X |

* cited by examiner

*Primary Examiner*—David H. Bollinger
(74) *Attorney, Agent, or Firm*—Townsend and Townsend and Crew

(57) ABSTRACT

A method and apparatus that perfects media while maintaining a constant grip on the media during the perfection process. A media perfection device comprises a rotating arrangement that rotates a gripper bar. The gripper bar comprises a fixed part, and a rotatable part to hold media. The rotation of the rotating arrangement rotates the rotatable part of the gripper bar, thus perfecting the media.

19 Claims, 5 Drawing Sheets

MATERIAL HANDLER APPARATUS

BACKGROUND

1. Field of the Invention

Aspects of the present invention relate in general to an apparatus that perfects paper, cardboard, greeting cards, cardstock and the like, during the manufacture of printed media.

2. Description of the Related Art

During the manufacture of printed media, such as greeting cards, paper, cardboard, cardstock, and the like, media may be processed on both sides. For example, in the art of greeting card manufacturing, a large sheet of media may be embossed on a first side, scored on the opposite side, then cut on the first side, and finally folded along the scored side to form a greeting card. An analogous situation is when a photocopying apparatus prints a "double-sided" photocopy, because both sides are processed during the manufacturing process.

In such cases, to simplify the manufacturing process, a single sheet is mechanically turned so that it may be processed on both sides of the media. The mechanical turning or "flipping" is known in the art as "perfecting" the media.

Conventionally, when media is processed, the media is held in a gripping arrangement. When the media is perfected, the media is released from the gripping arrangement, flipped, and then regripped for further printing. This is done because most conventional systems accomplish the media perfection through a system of rollers or other sheet-turning drums.

SUMMARY

In one embodiment, a media perfection device comprises a rotating arrangement that rotates a gripper bar. The gripper bar comprises a fixed part, and a rotatable part to hold media. The rotation of the rotating arrangement rotates the rotatable part of the gripper bar, thus perfecting the media.

DETAILED DESCRIPTION

Aspects of the invention encompass the discovery of flaws and problems of conventional perfection apparatuses caused by releasing the media when the media is being perfected. Apparatus and method embodiments of the invention further facilitate the perfection of media through an automatic manufacturing system. In one aspect of the present invention, the apparatus continuously holds the media, never having to release the hold on the media as the media is perfected.

Figure 1:
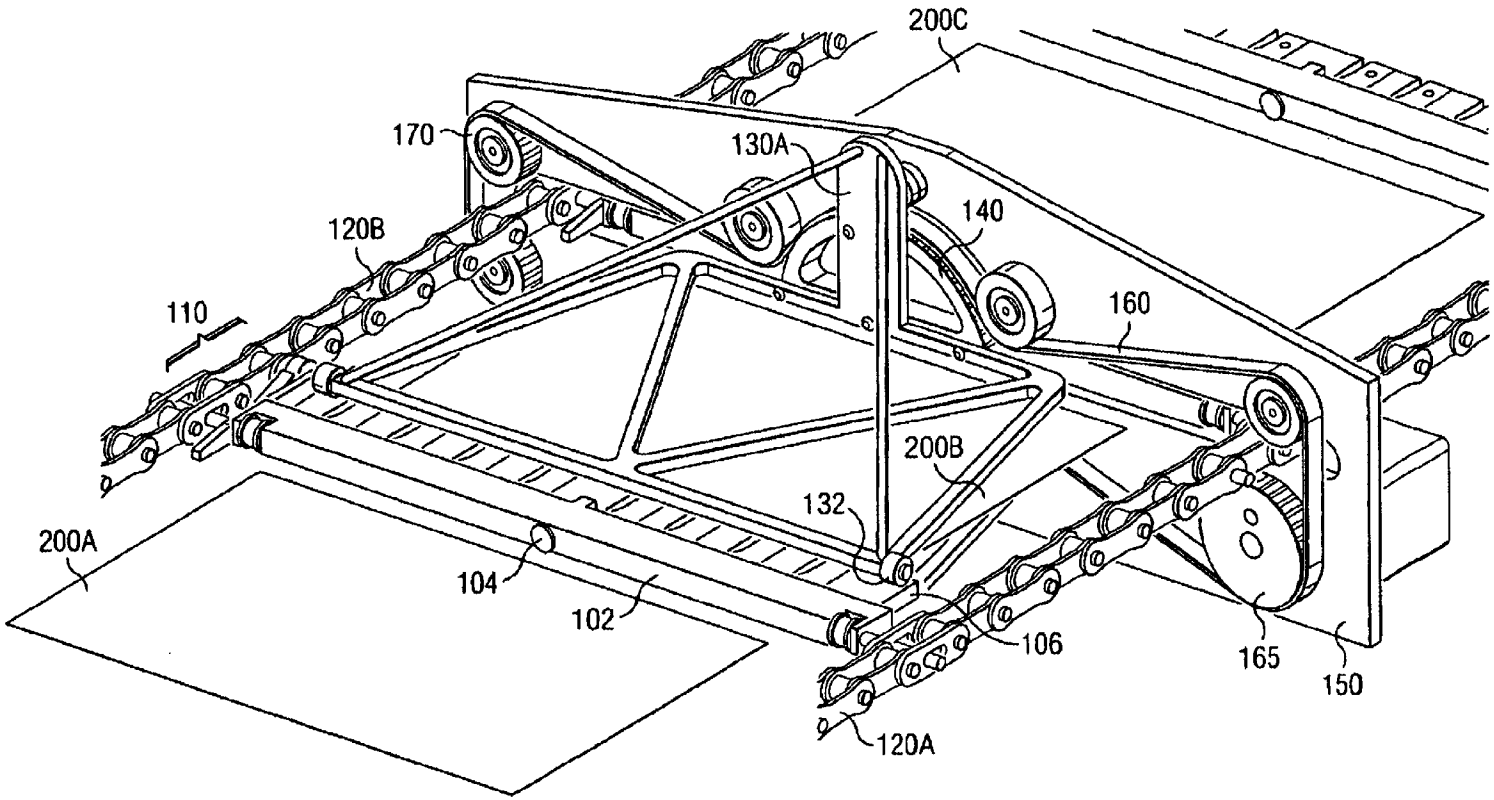
FIG. 1 is a diagram illustrating an apparatus embodiment that mechanically perfects media.

FIG. 1 is a diagram illustrating an apparatus embodiment that mechanically perfects media, constructed and operative in accordance with an embodiment of the present invention. FIG. 1 illustrates how a rotating arrangement 130 may be used to rotate gripper bar 110. The gripper bar maintains its hold on the media 200, and thus the media 200 is mechanically perfected without requiring the ungripping and regripping.

As is shown, a perfector apparatus embodiment includes a gripper bar 110 and a rotating arrangement 130 or "perfector" 130 as part of an automatic manufacturing system.

Gripper bar 110 comprises a fixed part 102, and a rotatable part 106. The rotatable part 106 is mounted to the fixed part 102. The fixed part 102 moves linearly through an assembly line conveyor, while the rotatable part 106 is designed to hold the media being processed.

In the conveying system, gripper bar 110 is carried between a pair of chains 120A–B through a longitudinal slot in a plate 150.

The perfector 130 adapted to flip the rotatable part 106 of the gripper bar 110 so that both sides of the media may be processed.

As part of the conveying system, the chains 120A–B and the gripper bar 110 pass through the longitudinal slot or opening 155 in the plate 150. The plate 150 rotatably carries a ring 140. The ring is connected to an arrangement that engages the rotatable part of the gripper bar. A belt drives the split ring and rotatable arrangement to rotate, thereby flipping the rotatable part of the gripper bar.

The ring 140 is rotatably carried by the plate 150. The ring 140 is connected to the rotating arrangement 130 that engages the rotatable part 106 of the gripper bar. When a motor (not shown) engages the drive gear 165. In turn, the drive gear moves the belt 160, which moves the ring 140. The movement of the split ring rotates the perfecter 130, which rotates the rotatable part 106, and thus perfects the media.

Figure 2:
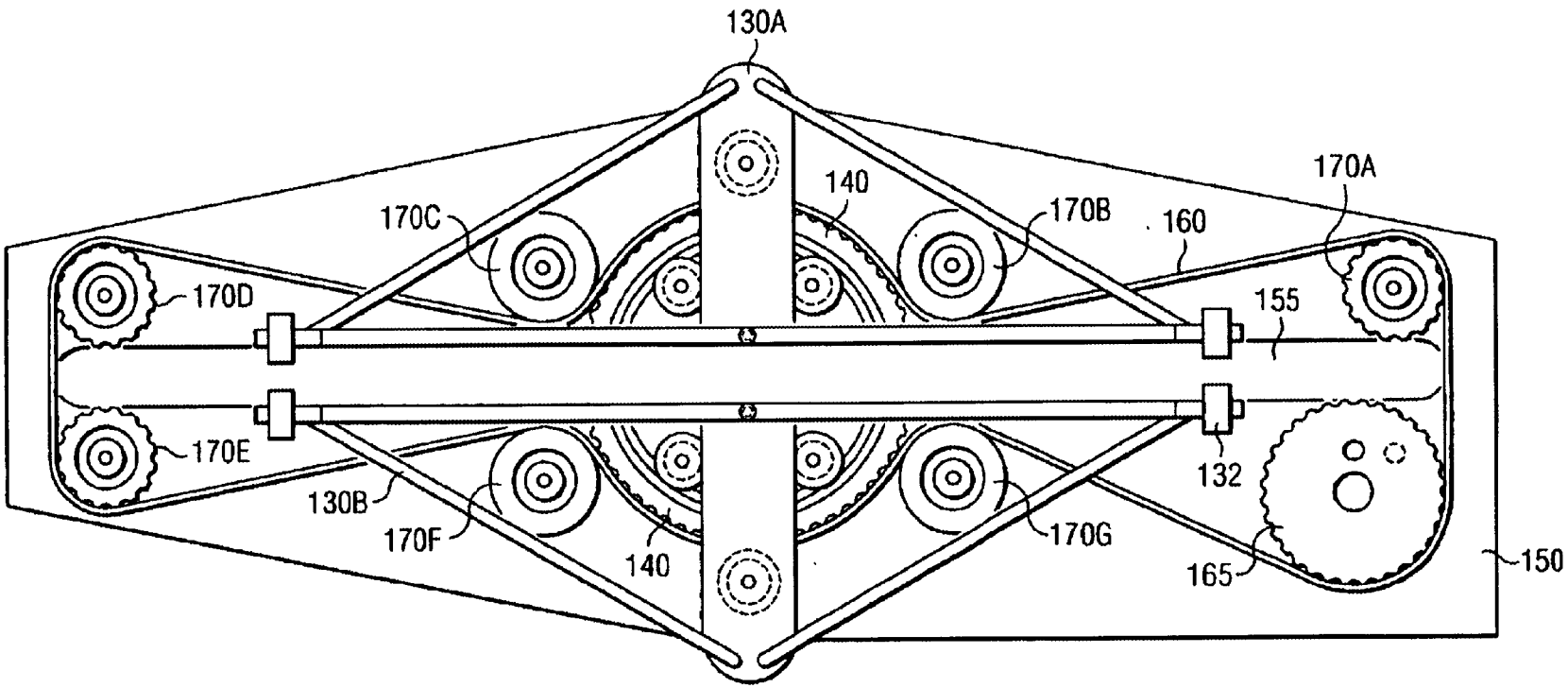
FIG. 2 illustrates an embodiment of a rotating arrangement to rotate the media to be mechanically perfected.

FIG. 2 illustrates an embodiment of a rotating arrangement 130 to rotate the media to be mechanically perfected, constructed and operative in accordance with an embodiment of the present invention.

The rotating arrangement 130 or "perfector" 130 is adapted to flip the rotatable part 106 of the gripper bar 110 so that both sides of the media may be processed.

The perfector 130 is coupled to a plate 150. In some embodiments, the perfector 130 is coupled to the plate 150 via a ring 140. The plate 150 has an elongated opening 155 therein. The elongated opening 155 within the plate 150 is large enough so that the chains 120A–B and the gripper bar 110 may pass through.

Figure 4:
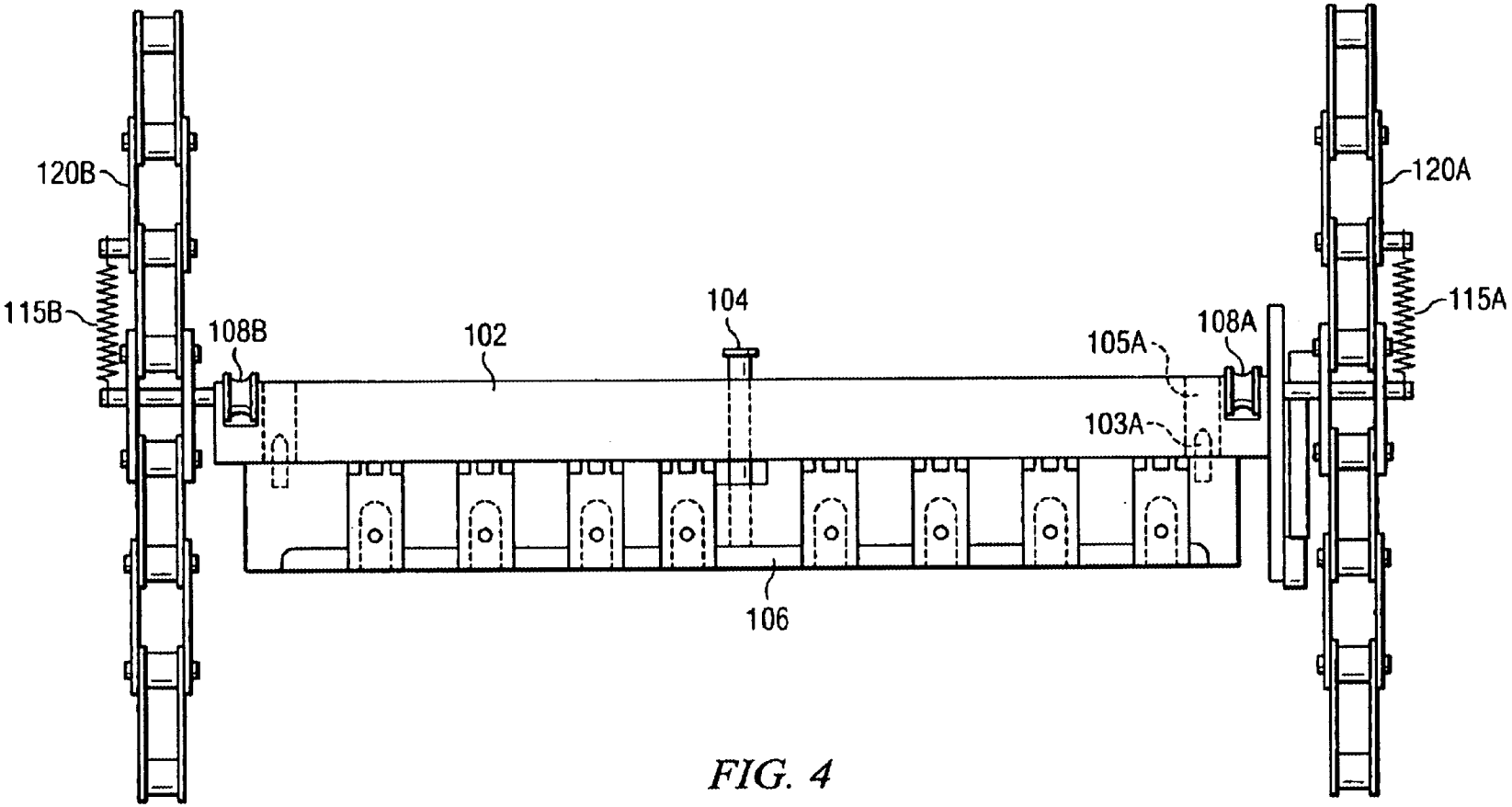
FIG. 4 shows a gripper bar embodiment suspended by a chain, as viewed from above.

The ring 140 is rotatably carried by the plate 150. The ring 140 is connected to the rotating arrangement 130. A belt 160, attached to a drive gear 165, moves the ring 140 and rotatable arrangement 130 to rotate. As shown in FIG. 4, gears 170A–G guide the belt so that it engages the ring 140. Drive gear 165 may be attached to any driving mechanism, such as a motor, as is known in the art.

As depicted in FIG. 2, ring 140 may be a split ring.

It is understood that alternative embodiments of the perfecter 130 may be used to engage and flip the rotatable part 106 of the gripper bar.

In some embodiments, the perfector 130 may engage the rotatable part 106 from above and below, as shown in FIG. 2.

In alternate embodiments, the perfector 130 may engage the rotatable part 106 from either above or below.

Figure 3:
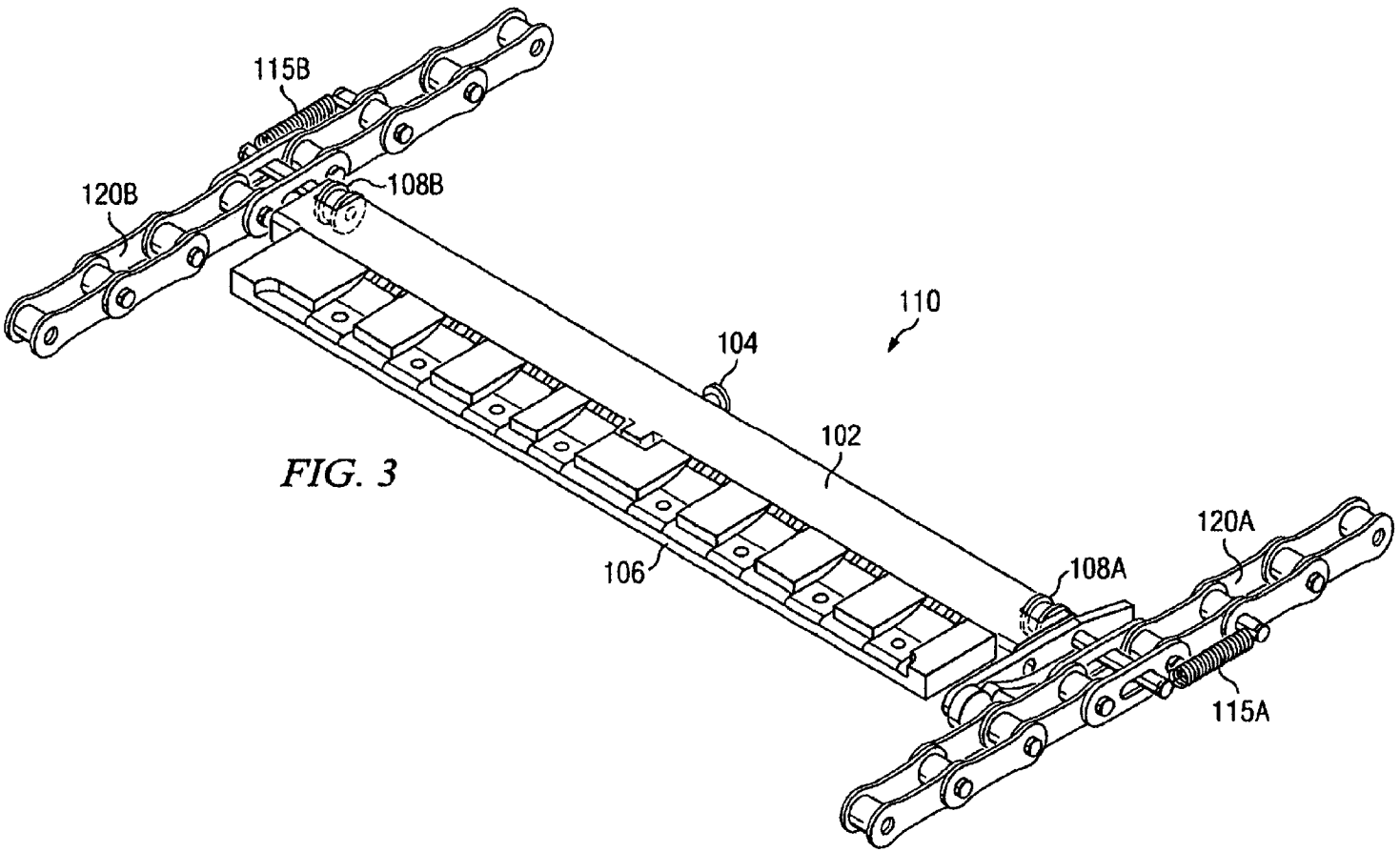
FIG. 3 depicts an embodiment of a gripper bar suspended by a chain.

FIGS. 3 and 4 depicts an embodiment of a gripper bar 110 suspended by a chain 120 as part of a conveyor or assembly line system, constructed and operative in accordance with an embodiment of the present invention. FIG. 3 illustrates the system at an angle, while FIG. 4 illustrates the same system as viewed from above.

As shown in FIGS. 3 and 4, a pair of springs 115A–B forward biases the fixed part 102 in the slots of the chains 120A–B. Stops are provided at each station where media is processed. Examples of media processing stations include, but are not limited to, locations where the media is printed, scored, cut, embossed, or otherwise treated. The stops engage rollers 108A–B on the fixed part 102 of the gripper bar 110 to stop the gripper bar 110 at a precise location. The stopped position may be independent of the position where the chain stops because of the forward bias imposed by the springs 115A–B.

Figure 5:
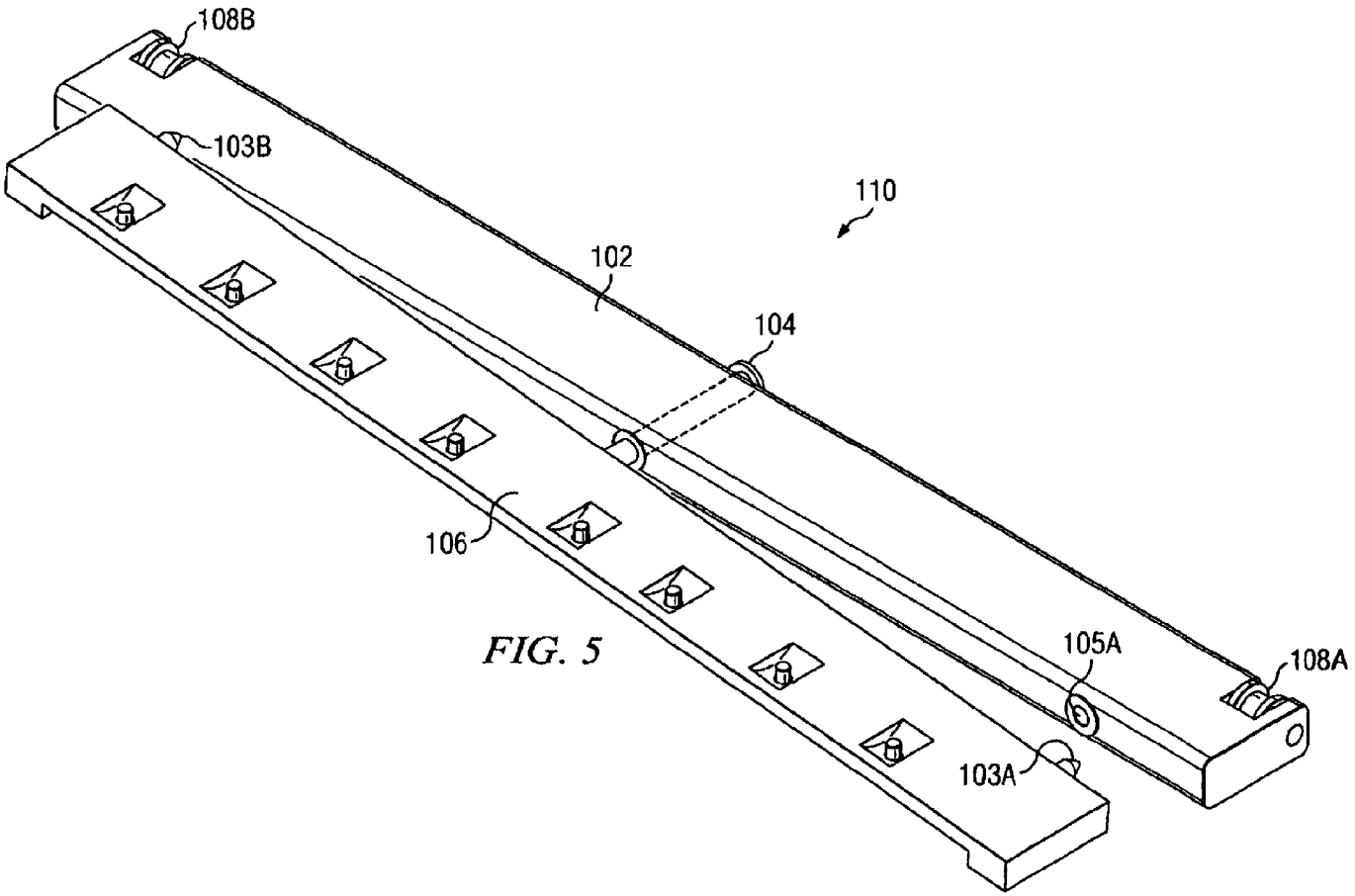
FIG. 5 illustrates an embodiment of a gripper bar to hold the media to be mechanically perfected.

FIG. 5 is a simplified functional block diagram depicting gripper bar 110, constructed and operative in accordance with an embodiment of the present invention. Gripper bar 110 is designed to hold media, and convey media from one manufacturing station to another manufacturing station along a linear media processing/assembly line.

Gripper bar 110 comprises a fixed part 102, and a rotatable part 106 mounted to the fixed part 102.

The fixed part 102 is the part of the gripper bar 110 that moves linearly through an assembly line conveyor.

The rotatable part 106 is designed to hold the media being processed. In some embodiments, the rotatable part 106 holds media by exerting pressure on the media, clamping the media between rubber teeth.

The mounting connection between the fixed part 102 and rotatable part 106 may be performed by any rotary joint 104 known in the art that allows the rotatable part 106 to rotate, including a rotary union, ball-bearing, or axle. In some embodiments, the rotary joint 104 is placed in the center of the fixed part 102 and the rotatable part 106, so that the rotatable part 106 is always centered along the axis of the rotary joint 104 and the fixed part 102. When the rotatable part 106 is rotated 180° along the rotary joint 104, while holding media, the media is perfected.

Rotatable part 106 and fixed part 102 may also have detents to lock the rotatable part 106 in a fixed position relative to the fixed part 102. For example, as shown in FIG. 1, the rotatable part 106 has male detents 103A–B, while the fixed part 106 has corresponding female detents 105A–B. It is understood, by those known in the art, that either part may have one or more of such male detents 103 and corresponding female detents 105. The male detents 103 may be spring-actuated, so that a light amount of pressure along the rotatable part 106 does not rotate the rotatable part 106. In such an embodiment, a known amount of threshold pressure may be required to rotate the rotatable part 106.

The rotatable part 106 is normally held parallel to the fixed part 102 by detents 103 105.

In some embodiments, fixed part 102 may have rollers 108 to help facilitate the movement of the fixed part 102 through a conveyor belt or other assembly line conveyance system.

The previous description of the embodiments is provided to enable any person skilled in the art to practice embodiments of the invention. The various modifications to these embodiments will be readily apparent to those skilled in the art, and the generic principles defined herein may be applied to other embodiments without the use of inventive faculty. Thus, the present invention is not intended to be limited to the embodiments shown herein, but is to be accorded the widest scope consistent with the principles and novel features disclosed herein.

What is claimed is:

1. A media perfection apparatus comprising:

a gripper bar with a supported fixed part, and a rotatable part to hold media;

a rotating arrangement to rotate, the rotation of the rotating arrangement to rotate the rotatable part; and, a ring, the rotating arrangement being mounted on the ring.

2. The apparatus of claim 1 further comprising: a plate with an opening, the ring being coupled to the plate.

3. The apparatus of claim 2, wherein the fixed part of the gripper bar is supported by chain links through the opening of the plate.

4. The apparatus of claim 1, further comprising: a driving mechanism coupled to the ring, to rotate the ring.

5. The apparatus of claim 4, wherein the driving mechanism is coupled to the ring via a flexible belt.

6. The apparatus of claim 1, wherein the rotatable part is held longitudinally in place with the fixed part by at least one detent.

7. The apparatus of claim 1, wherein the ring is a split ring.

8. A media perfection apparatus comprising:

gripping means for holding media; and rotating means for rotating the gripping means, the rotating means including:

means for engaging the gripping means, and a ring arranged to rotate the means for engaging the gripping means.

9. The apparatus of claim 8, further comprising: means for supporting the rotating means;.

10. The apparatus of claim 9, wherein the means for supporting the rotating means comprises a plate having an opening for the passage of the gripping means therethrough.

11. The apparatus of claim 10, wherein the gripping means comprises:

a non-rotating bar; and, a rotating bar rotatably mounted to the non-rotating bar.

12. The apparatus of claim 11, including means for advancing the gripping means through the opening of the plate.

13. The apparatus of claim 12, wherein the means for advancing the gripping means through the opening of the plate includes a drive chain connected to said non-rotating bar.

14. apparatus of claim 10, wherein said ring includes a split ring arrangement having a first half supported on one side of the opening of the plate and a second half supported on the other side of the opening of the plate.

15. The apparatus of claim 8, wherein the gripping means is supported by chain links.

16. The apparatus of claim 15, further comprising: a driving mechanism coupled to the rotating means, to rotate the ring.

17. The apparatus of claim 16, wherein the driving mechanism is coupled to the rotating means via a flexible belt.

18. The apparatus of claim 8, wherein the gripping means is held longitudinally in place by at least one detent.

19. A media handling apparatus, which comprises:

a plate, the plate having an opening therethrough;

a conveyor arranged to pass through the opening of the plate;

a bar carried by said conveyor;

a media gripper rotatably coupled to the bar;

a split ring arrangement having a first half supported on one side of the opening of the plate;

a first rotating member connected to the first half of the split ring arrangement, the first rotating member being engageable with the media gripper; and, means for rotating the split ring arrangement so that the first half moves to the other side of the opening of the plate.

* * * * *

UNITED STATES PATENT AND TRADEMARK OFFICE

CERTIFICATE OF CORRECTION

PATENT NO. : 6,786,482 B2
DATED : September 7, 2004
INVENTOR(S) : Jeffrey M. Spatz It is certified that error appears in the above-identified patent and that said Letters Patent is hereby corrected as shown below:

Column 4,
Line 38, delete “;”.

Signed and Sealed this

Seventh Day of December, 2004

JON W. DUDAS
*Director of the United States Patent and Trademark Office*